US006068498A

United States Patent [19]

Strack

[11] Patent Number: 6,068,498

[45] Date of Patent: May 30, 2000

[54] PLUG CONTACT PAIRING WITH SPARK PROTECTION

[75] Inventor: Holger Strack, Bamberg, Germany

[73] Assignee: Wieland Electric GmbH, Bamberg, Germany

[21] Appl. No.: 09/084,791

[22] Filed: May 27, 1998

[30] Foreign Application Priority Data

May 30, 1997 [DE] Germany ..... 197 22 543

[51] Int. Cl.[7] ..... H01R 13/53

[52] U.S. Cl. ..... 439/181

[58] Field of Search ..... 439/843, 851, 439/852, 181, 186, 187, 127; 445/7, 18; 123/169 P, 169 E, 169 PH; 313/118, 130, 132, 131 R, 135, 141, 139, 143

[56] References Cited

U.S. PATENT DOCUMENTS 4,163,597 8/1979 Brenholts ..... 439/126
5,433,622 7/1995 Galambos ..... 439/282
5,591,039 1/1997 Matthews ..... 439/181
5,929,556 7/1999 Matsubara et al. ..... 313/141

FOREIGN PATENT DOCUMENTS 67484 6/1969 Germany .

*Primary Examiner*—Michael L. Gellner
*Assistant Examiner*—Barry M. L. Standig
*Attorney, Agent, or Firm*—Venable; George H. Spencer; Catherine M. Voorhees

[57] ABSTRACT

A female contact (1) for a plug and socket contact arrangement, comprising a spark protection sleeve for holding a socket contact (5) and provided with an insertion opening (2) for the plug pin (3) of said plug and socket contact, wherein the insertion opening (2) of the spark protection sleeve is arranged eccentrically, relative to the center longitudinal axis (6) of the socket contact (5) and wherein the opening rim (8) of the insertion opening (2) is slanted at an angle other than 90° to the center longitudinal axis (6).

9 Claims, 6 Drawing Sheets

PLUG CONTACT PAIRING WITH SPARK PROTECTION

BACKGROUND OF THE INVENTION

1. Field of the Invention

Above all, the invention concerns a female contact as well as a plug contact pairing, consisting of plug and socket, with a spark protection according to the preamble to claim 1. The problem with such plug contact pairings is that when plug pin and socket contact are separated, an electric arc that is also called a breaking spark can occur if the contact pairing is separated under load, meaning the circuit is not shut down before plug and socket are separated. Such contact pairings which are separated under load are also referred to as "hot-plug systems." Said systems are used, for example, in computers that supply computer networks as servers. For safety reasons, such servers are provided with so-called "mirrored hard disks," meaning they are provided with two synchronously operating mass storage media. If one of the mass storage media is defective, it does not result in a data loss. Rather, the data still exist on the other mass storage medium, so that the defective storage medium must only be replaced. In order to prevent a standstill of the complete network, such a replacement must be possible under load, so that the computer can continue to operate without a problem during the replacement of the storage medium, that is to say the hard disk.

When separating the plug contact pairings under load, an electric arc called a breaking spark normally occurs from one to the other. This electric arc causes a soldering effect on the contact elements. Material is thus partially removed from the contact elements. The material removed from one contact element can be deposited on the other contact element. Material can thus be removed at the socket contact, which is then deposited on the plug pin. If the plug pin in turn is again fitted into the socket, this removed material can damage the socket and, in the worst case, can lead to a failure of the socket during repeated plugging in, thus causing the plug contact pairing to fail. This destruction of the contacts is especially effective if the roots of the electric arc originate directly at the contact faces.

Placing the socket contacts into conducting spark protection sleeves to alleviate this problem is already known. The conducting spark protection sleeve ensures that the electric arc does not occur between the plug pin and the actual socket contacts, but in the region of the insertion opening for the plug pin on the spark protection sleeve. A material removal at the socket contacts is prevented in this way. Thus, the previously mentioned soldering involving material removal and material deposit occurs only in the region of the electrically conducting spark protection sleeve and the tip of the plug pin. As a result, the contact faces that are positioned opposite each other when plug and socket are connected are not touched by the electric arc.

2. Description of the Related Art

With respect to this, the U.S. Pat. No. 5,591,039 discloses the positioning of a metal ring in front of a contact lamination ring, arranged inside a female contact. This is designed to avoid damage to the contact laminations through electric arc discharges that may occur during the coupling with a contact pin. However, even when using an electrically conducting spark protection sleeve, there is a tendency for the removed material to be deposited in the region of the insertion opening. This material removal or the material deposit, in turn, can either damage the socket pin during the insertion into the insertion opening or can prevent the insertion of the socket pin into this opening completely.

Starting with the described disadvantages, it is the object of the invention to configure a generic female contact or a generic plug contact pairing, such that the deposit of material in the region of the insertion opening is reduced or prevented completely. This object is solved inventively with the combination of features in claim 1.

BRIEF SUMMARY OF THE INVENTION

The basic idea behind the invention is a pre-defined control of the breaking spark or the electric arc along the opening rim for the spark protection sleeve, away from the actual insertion region of the insertion opening and toward a region of the spark protection sleeve that is far removed from the insertion opening. To be sure, the invention does not prevent the formation of deposits completely. However, these deposits form in a region of the opening rim that is removed from the insertion region of the insertion opening, with the result that if the plug pin is inserted again, there is no contact with the material removed as a result of the electric arc and deposited on the spark protection sleeve.

In order to solve this problem, the insertion opening for the spark protection sleeve is above all positioned eccentrically, relative to the center longitudinal axis of the socket contact. Owing to this eccentric arrangement, the plug pin is not guided concentrically through the insertion opening of the spark protection sleeve, but penetrates the insertion opening of this spark protection sleeve also in an eccentric manner. Inside the actual socket contact, the plug pin is subsequently again positioned concentrically. The center longitudinal axes of plug pin and socket contact also extend concentrically or congruent.

The collar-type rim of the insertion opening is furthermore designed with a slant, at an angle other than 90° to the center longitudinal axis of the socket contact. As a result of this slant, the opening rim of the insertion opening of the spark protection sleeve rises over a specific range, that is on the side facing away from the spark protection sleeve. The opening rim edge thus forms a line with helical course.

Owing to the eccentricity of the insertion opening for the spark protection sleeve and the center longitudinal axis of the socket contact, one region of the insertion opening of the spark protection sleeve is very close to the plug pin. The electric arc occurs at this point when the plug pin is pulled out. If the plug pin is pulled out even further, a certain overlapping with the plug pin still always exists as a result of the overlapping of the slanted opening rim. Owing to the slanted course of the opening rim and the pull-out movement of the plug pin, the root of the electric arc travels upward, along the opening rim and away from the insertion opening. In this case, the electric arc always follows the shortest distance from the tip of the plug pin to the upper opening rim. The root of the electric arc here moves over the opening rim and is thereby cooled as well. This leads to a more rapid extinguishing of the electric arc than would otherwise occur if the electric arc root were stationary at the opening rim. The electric arc the breaks in an opening rim region that is far removed from the actual insertion opening. Thus, if a material removal takes place and if subsequently a material residue is deposited at the insertion opening to the socket contact, said material residue deposit occurs in an insertion opening region that is far removed from the actual insertion opening. This distance prevents the plug pin from being damaged or the removed material from being reintroduced when the plug pin is inserted. Owing to the specified eccentricity of the center longitudinal axis of the socket contact and the insertion opening, the plug pin when reinserted never comes in contact with regions of the opening rim that may contain deposits.

The claims referring back concern advantageous embodiments and modifications of the invention. Thus, the cylindrical shape of the socket contact and spark protection sleeve, claimed in claim 2, is particularly well suited for a joint operation with equally cylindrical plug pins. The distribution of energy is particularly good with such cylindrical shapes.

The claims 3 and 4 respectively concern advantageous embodiments of the opening rim, whereby the lowest section of the opening rim is at the same time arranged radially closest to the plug pin. In an analog manner, the highest location of the opening rim has the longest radial distance to the plug pin and thus to the center longitudinal axis of the socket contact. The short radial distance according to claim 3 ensures that the electric arc at the opening rim actually sparks over, that is to say that it actually occurs. By arranging the highest point of the opening rim in that region, which has the longest radial distance to the center longitudinal axis of the socket contact and thus the plug pin, it is achieved that the electric arc breaks at a location that is far removed from the actual insertion opening for the plug pin. Possibly removed material consequently is also deposited at this location, which is far removed from the actual insertion opening, so that the effect intended by the invention can be achieved with particular certainty. It is thereby ensured that a material deposit occurs in a region that is far removed from the actual insertion opening.

Claim 5 concerns the combination of the teaching in claims 2 to 4, to the effect that on the one hand the lowest point on the opening rim and on the other hand the highest point on the opening rim are located opposite each other. With this embodiment, the path traveled by the electric arc along the opening rim is maximized. The electric arc consequently breaks at a location on the opening rim of the spark protection sleeve that is far removed from the socket contacts.

The convex design of the opening rim, suggested in claim 6, furthermore favors the shifting of possible material deposits away from the actual insertion region for the plug pin and toward the outer edge of the opening rim. The material deposits are thus shifted away from the actual location where the contact pairing occurs and to an outer region on the opening rim of the spark protection sleeve, which region has no effect on the actual contact pairing.

The undercut region on the spark protection sleeve, which develops in the region of the insertion opening as a result of the features in claim 7, permits a pre-stressed positioning of the contact elements forming the socket contact. The beading, which is effective as undercut, in this case functions as pre-stressing element for the contact elements, e.g. configured as contact laminations. The prestressed contact laminations make it easier to insert the plug pins by reducing the forces for inserting and pulling out. The opening rim of the spark protection sleeve is thus provided with a dual function.

The material selection suggested in the claims 8 and 9 for at least some sections of the plug pins increases the effectiveness of the invention, thereby ensuring that the electric arc actually breaks only at the desired location. This effectively prevents an undesirable, premature breaking of the electric arc at a location that is considered critical.

BRIEF DESCRIPTION OF THE SEVERAL VIEWS OF THE DRAWINGS

The invention is explained in further detail with the aid of the exemplary embodiment described in the drawing. Shown are in.

DETAILED DESCRIPTION OF THE INVENTION

Figure 1A:
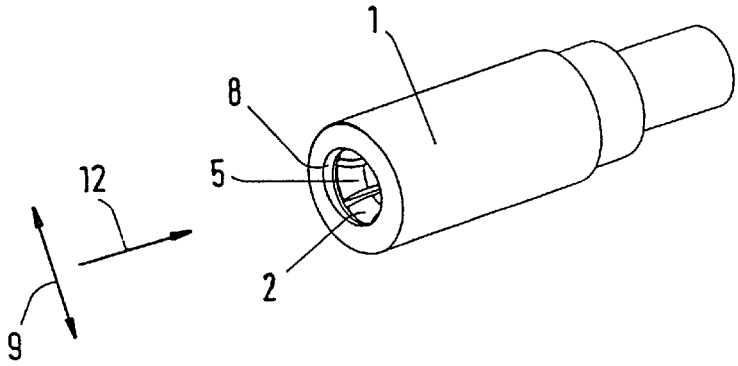
FIG. 1*a* A perspective view of the female socket with view of the insertion opening.
Figure 2A:
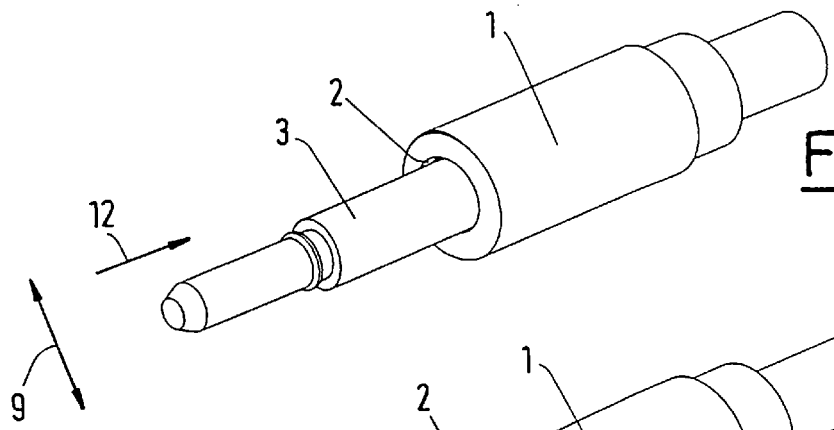
FIG. 2*a* A perspective view of the contact pairing according to the invention, wherein the plug pin is pulled from the socket contact, but where the plug pin still makes contact with the spark protection sleeve.
Figure 3A:
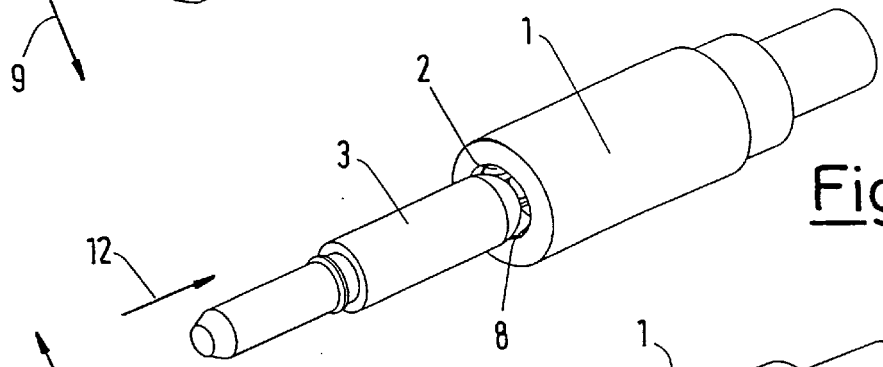
FIG. 3*a* A perspective view of the contact pairing with nearly pulled-out plug pin.
Figure 4A:
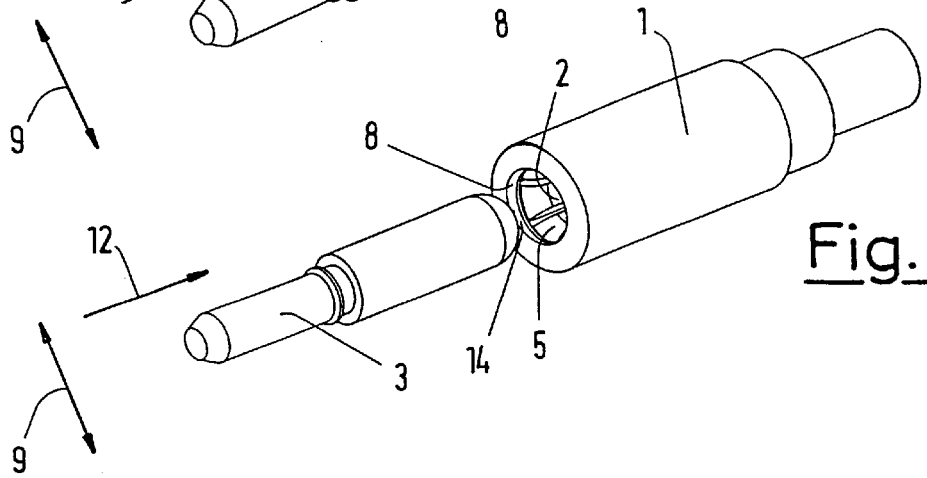
FIG. 4*a* The contact pairing according to the invention while completely pulled apart.
Figure 1B:
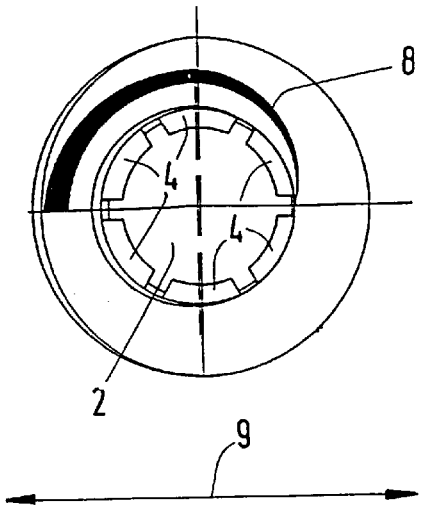
FIG. 1*b* A view from above of the insertion opening of the female socket according to FIG. 1*a;*

The female socket essentially consists of the conducting spark protection sleeve 1 and the socket contact 5, arranged inside the spark protection sleeve 1. On one front, the spark protection sleeve 1 has an insertion opening 2. A plug pin 3 can be inserted into the insertion opening 2. The socket contact 5, which for the exemplary embodiment consists of individual contact laminations 4, is arranged inside the spark protection sleeve 1.

The insertion opening 2 is arranged eccentrically to the center longitudinal axis 6 of socket contact 5. Owing to this eccentric positioning of insertion opening 2 to the center longitudinal axis 6, the plug pin 3 is also positioned eccentrically in the insertion opening 2. When pulling the plug pin 3, this eccentric positioning causes the plug pin 3 to rest against the lowest point 7 of the opening rim 8, that is to say the plug pin 3 and the opening rim 8 together form a direct contact at the lowest point 7.

In radial direction 9, the lowest point 7 of opening rim 8 is located opposite the highest point 10 of opening rim 8. The plug pin 3 is at a distance 11 to this highest point 10 of opening rim 8 as a result of the aforementioned eccentricity to the insertion opening 2.

Figure 2B:
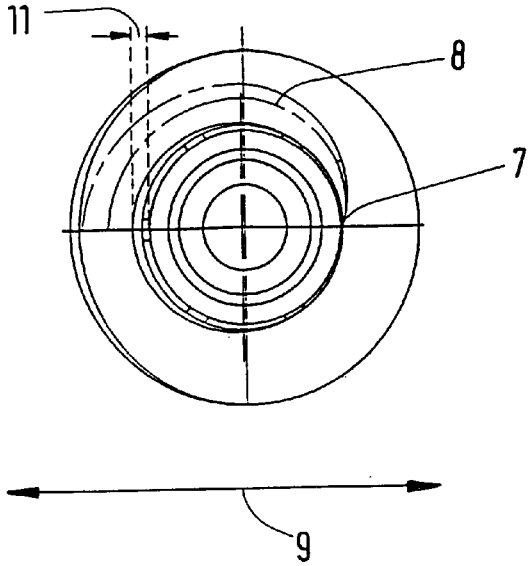
FIG. 2*b* A view from above according to FIG. 1*b* of the contact pairing according to FIG. 2*a;*
Figure 3B:
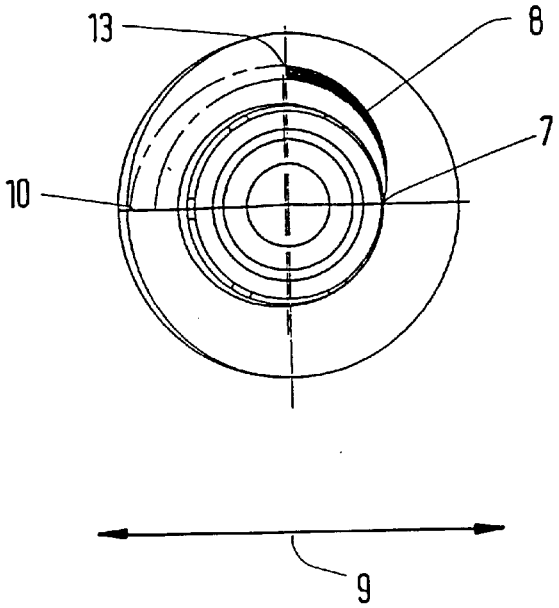
FIG. 3*b* A view from above according to FIG. 1*b* of the contact pairing shown in FIG. 3*a;*
Figure 3C:
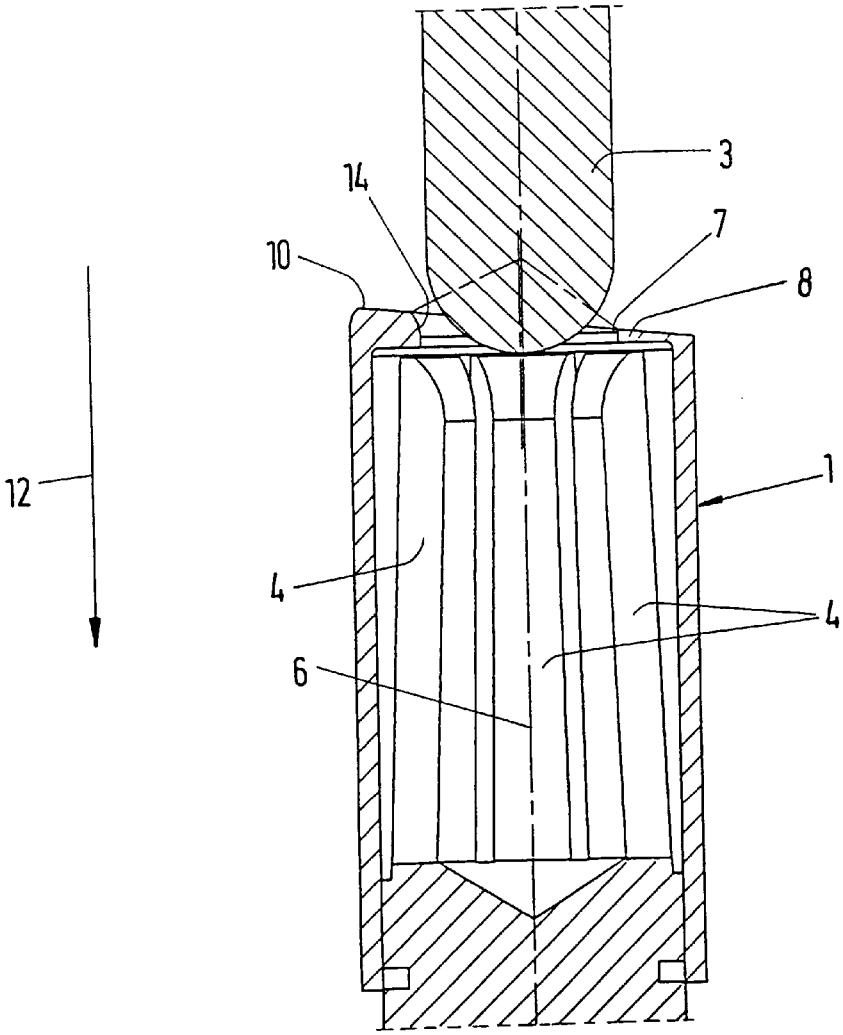
FIG. 3*c* A sectional view from the side of the contact pairing shown in FIG. 3*a;*

If plug pin 3 is pulled further out of the spark protection sleeve 1, counter to the insertion opening 12, then the breaking spark root that develops at the lowest point 7, meaning the electric arc developing during the pulling out, wanders in the embodiment shown in counterclockwise direction along the opening rim 8. In contrast to the illustration in FIG. 2*b*, where it is located at the lowest point 7, the root of the breaking spark is located at a contact point 13 that is at a distance in counterclockwise direction to lowest point 7 if the plug pin 3 is pulled out even further (FIG. 3*c*). The contact point 13 is indicated in FIG. 3*b*.

Figure 4B:
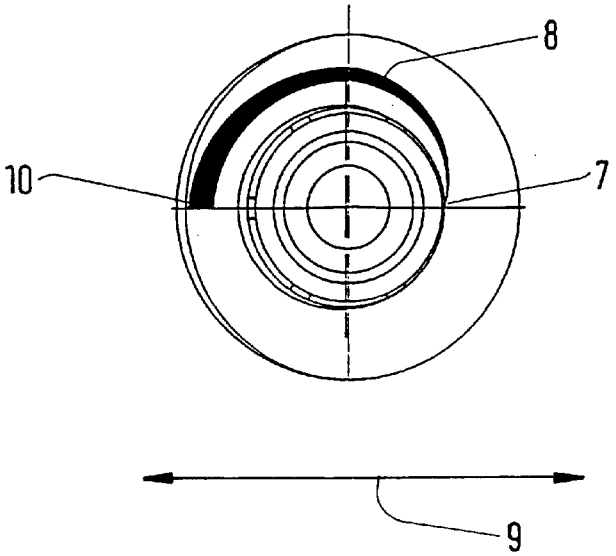
FIG. 4*b* A view from above according to FIG. 1*b* of the contact pairing shown in FIG. 4*a;*
Figure 4C:
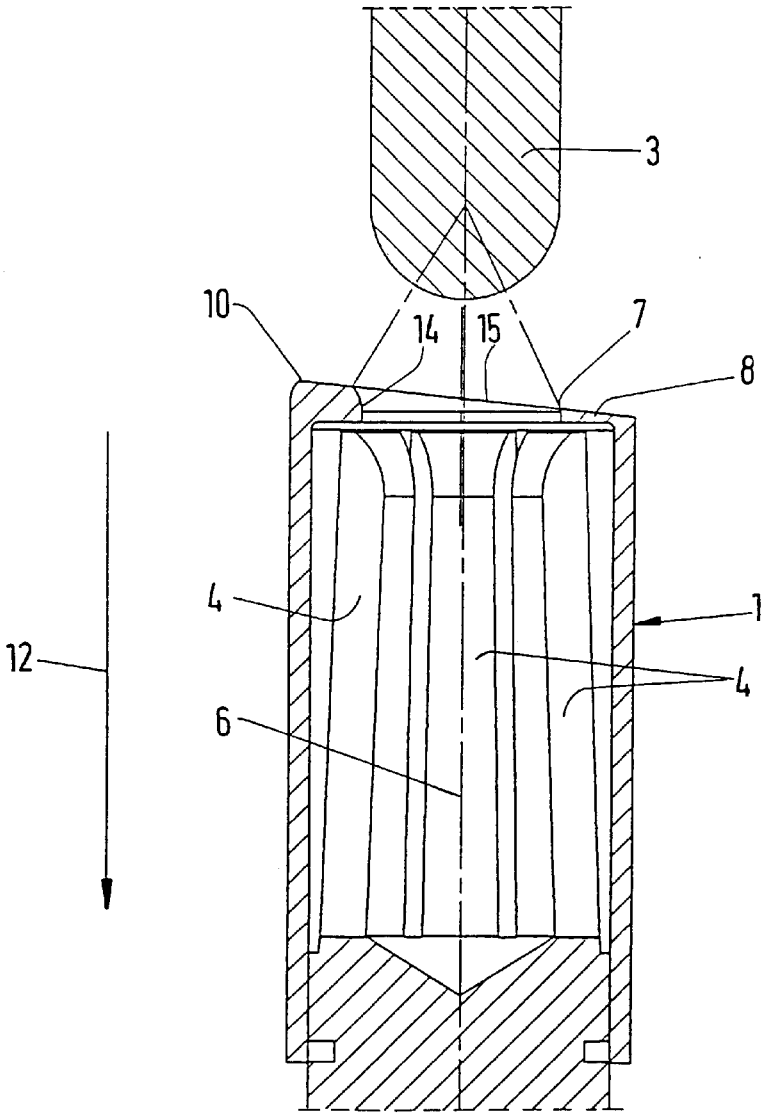
FIG. 4*c* A sectional view from the side of the contact pairing shown in FIG. 4*a*, as well as FIG. 5 A basic diagram of the female socket with beading around the edge region.

Finally, the FIGS. 4*c* or 4*b* show the contact pairing in a state where plug and socket are separated completely, wherein prior to the breaking of the electric arc, the root of the breaking contact has wandered so-to-speak in counterclockwise direction by 180°, from the lowest point 7 to the highest point 10 on the opening rim 8. In this case, any possible material deposits would have formed in the region of the highest point 10 of the opening rim 8.

Figure 2C:
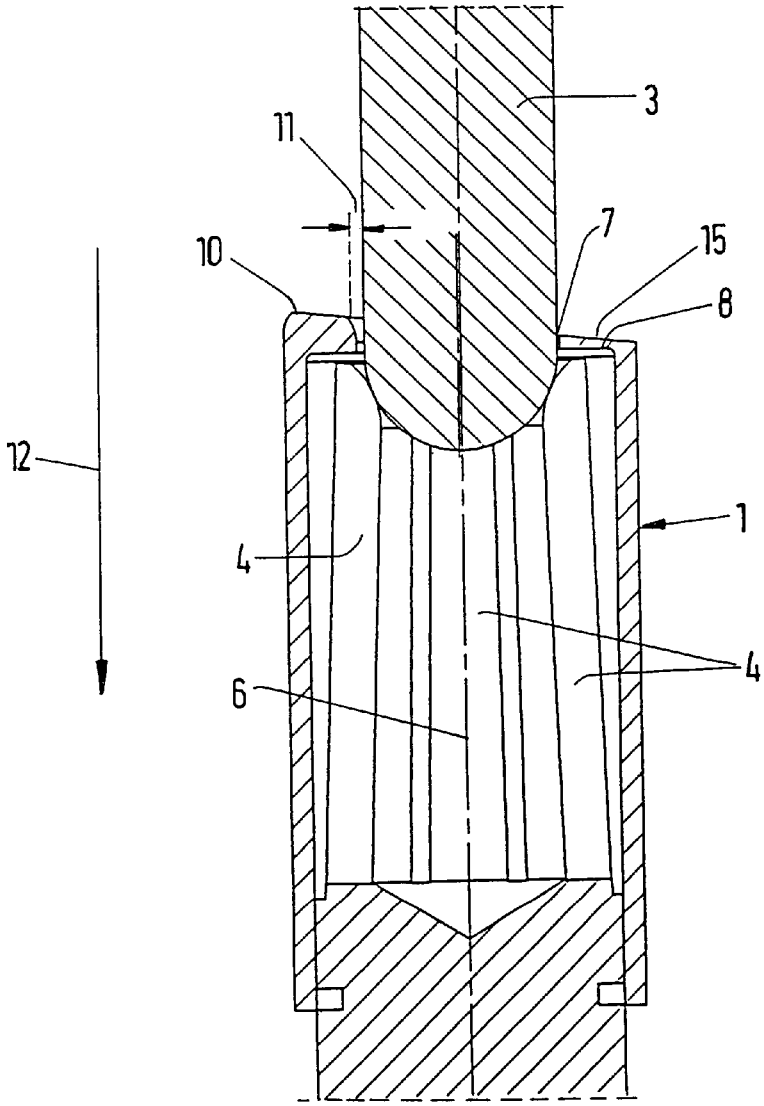
FIG. 2*c* The contact pairing shown in FIG. 2*a*, shown here as a sectional view.

A comparison of the FIGS. 2*c*, 3*c* and 4*c* clearly shows how the shortest distance between the tip of the plug pin 3 and the opening rim 8 of the spark protection sleeve 1 is continuously displaced from the lowest point 7 to the highest point 10 of the opening rim 8.

Figure 1C:
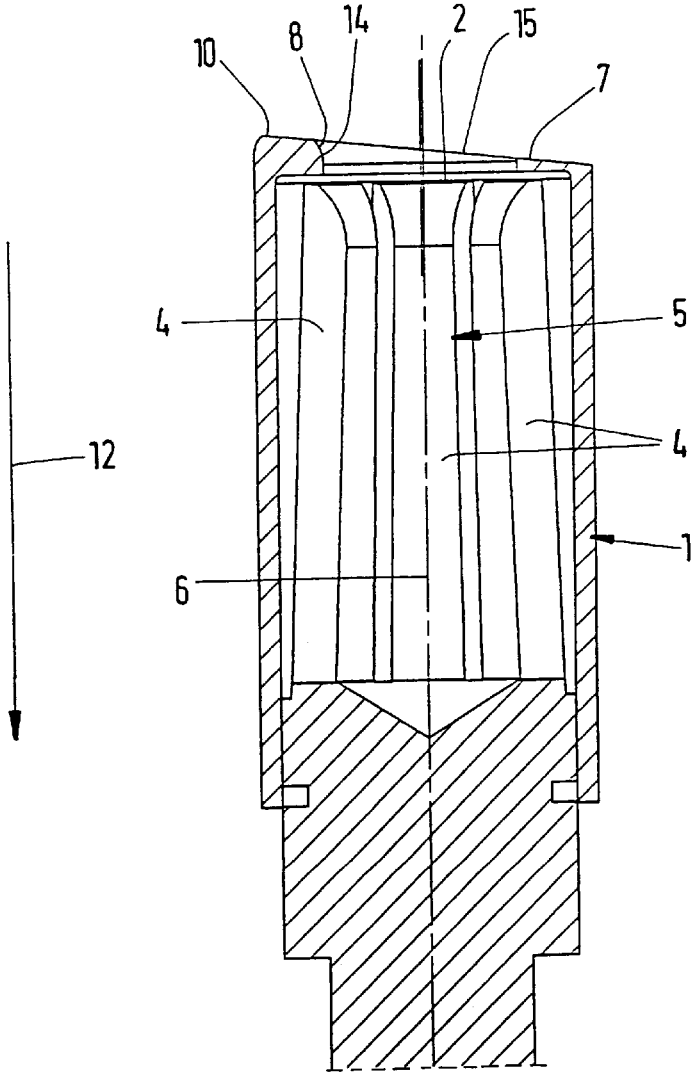
FIG. 1*c* A sectional view of the female socket shown in FIG. 1*a;*

The convex design of opening rim 8 is shown in the drawing and indicated by the convex region 14 in FIGS. 1*c*, 3*c* and 4*c*. Also shown is the slanted position of opening rim edge 15, relative to the center longitudinal axis 6.

Figure 5:
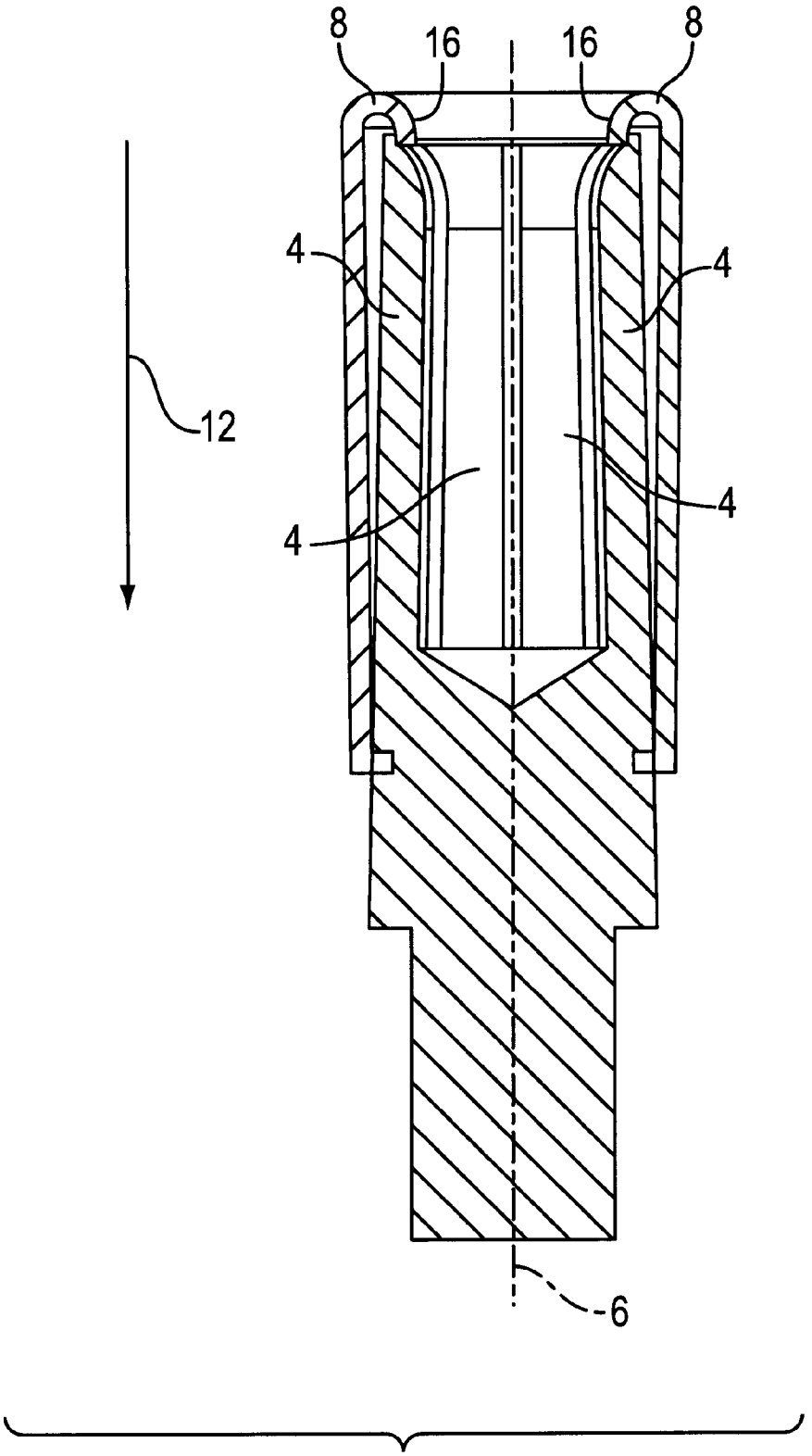

Finally, FIG. 5 is a diagrammatic illustration of the beading 16 around the opening rim 8. Although the slant of opening rim 8 to the center longitudinal axis 6, which differs from 90°, is not shown in FIG. 5, it still exists. Beading 16 keeps respectively one contact lamination 4 in the prestressed state.

The contact pairing according to the invention and as shown in the embodiment functions in that the root of the electric arc, also called a breaking spark, is controlled during the pulling out of plug pin 3 in such a way that for the embodiment shown it moves counterclockwise from the lowest point 7 along the opening rim 8 of the spark protection sleeve 1 to the highest point 10 where it breaks. Possible material deposits are thus deposited next to the convex region 14 on the upper edge of the opening rim 8.

I claim:

1. A female contact for a plug and socket contact arrangement, comprising a conducting spark protection sleeve that holds a socket contact and having an insertion opening for a plug pin of the plug contact, wherein the insertion opening of the spark protection sleeve is arranged eccentrically to a center longitudinal axis of socket contact and an opening rim of the insertion opening is slanted relative to the center longitudinal axis at an angle other than 90°.

2. The socket according to claim 1, characterized by a cylinder arrangement of contact elements that form the socket contact, and a corresponding cylinder-shaped spark protection sleeve.

3. The socket according to claim 1, wherein a lowest point on the opening rim has the shortest radial distance to the opening rim of the center longitudinal axis.

4. The socket contact according to claim 1, wherein a highest point on the opening rim has a longest radial distance of the opening rim to the center longitudinal axis.

5. The socket according to claim 1, wherein a lowest point and a highest point of the opening rim are arranged on a circular front of the opening rim, at a distance of 180° to each other.

6. The socket according to claim 1, wherein a region of opening rim, which serves as insertion funnel for the plug pin, has a convex design.

7. The socket according to claim 1, wherein contact elements forming the socket contact are opening elements, e.g. contact laminations and an edge region of the spark protection sleeve has a beading in the direction of the socket inside area, in such a way that the beading grips spring elements from behind, respectively on one end, in order to introduce a prestressing force into the spring elements.

8. A contact pairing, consisting of a female contact according to claim 1 and a plug pin, wherein a contact tip for a plug pin, consists of a particularly spark-resistant contact material.

9. The contact pairing according to claim 8, wherein the contact tip consists of AgCdO.

* * * * *